United States Patent [19]

Prioretti

[11] Patent Number: 4,535,701

[45] Date of Patent: Aug. 20, 1985

[54] DEVICE FOR SLOWING DOWN AND STOPPING MACHINES ROLLING ON RAILS

[76] Inventor: Guy Prioretti, 8 Rue Saint-Louis, 54400 Longwy, France

[21] Appl. No.: 467,225

[22] Filed: Feb. 17, 1983

[30] Foreign Application Priority Data

Feb. 17, 1982 [FR] France ..... 82 02582

[51] Int. Cl.[3] ..... B61K 7/06; B61K 7/20

[52] U.S. Cl. ..... 104/258; 104/259; 104/260; 188/43

[58] Field of Search ..... 104/257–260; 188/41, 43, 45, 63

[56] References Cited

U.S. PATENT DOCUMENTS

| | | | |
|---|---|---|---|
| 519,624 | 5/1894 | Barthelmess | 104/260 |
| 962,967 | 6/1910 | Lindsay | 104/258 |
| 1,448,672 | 3/1923 | Neumann | 188/45 |
| 1,852,703 | 4/1932 | Crews | 104/258 |
| 2,121,775 | 6/1938 | McCullough | 104/258 |
| 2,359,106 | 9/1944 | Hayes | 104/258 |
| 2,874,645 | 2/1959 | Beck | 104/260 |

FOREIGN PATENT DOCUMENTS

| | | |
|---|---|---|
| 13003 | 3/1881 | Fed. Rep. of Germany . |
| 19947 | 11/1882 | Fed. Rep. of Germany . |
| 39614 | 6/1887 | Fed. Rep. of Germany . |
| 543932 | 9/1922 | France . |
| 2256063 | 7/1975 | France . |
| 2495085 | 6/1982 | France . |
| 193214 | 12/1937 | Switzerland . |

*Primary Examiner*—Randolph A. Reese

*Attorney, Agent, or Firm*—Wenderoth, Lind & Ponack

[57] ABSTRACT

The device comprises a body (1) for placing on a rail (R) for the purpose of receiving a wheel of a machine to be slowed down and stopped and forming an abutment for the wheel, and an arrangement for connecting the device to the rail. The connecting arrangement comprises a plate (7) carrying elastically yieldable claws (10 and 11) which are maintained spread apart in their position of rest. The plate (7) is adapted to be applied against the rail (R) and is pivotally connected to an arrangement (21) for moving the claws (10 and 11) towards each other for the purpose of closing them around the head of the rail. The arrangement (21) is connected to the body (1) of the device.

20 Claims, 4 Drawing Figures

FIG. 1
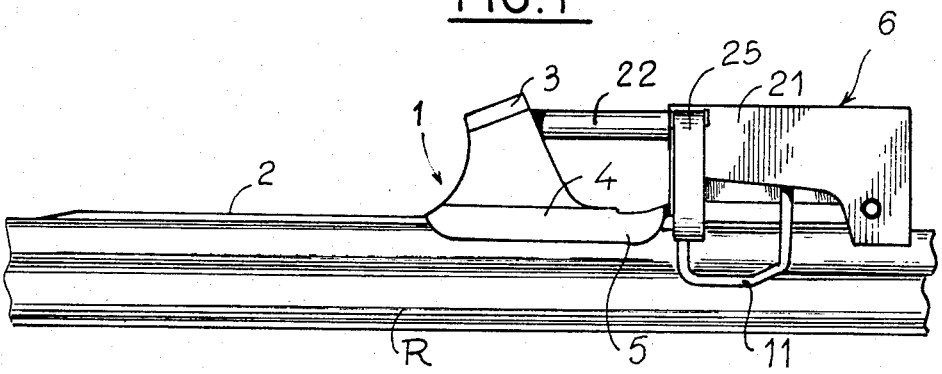
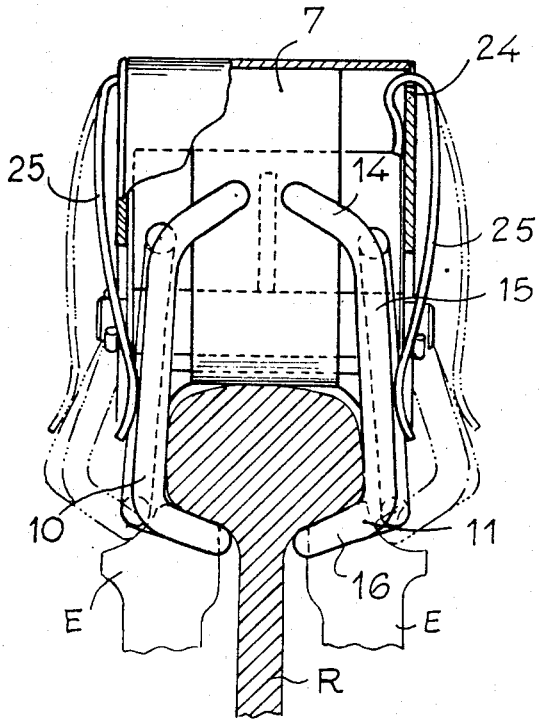
FIG. 2

FIG. 3
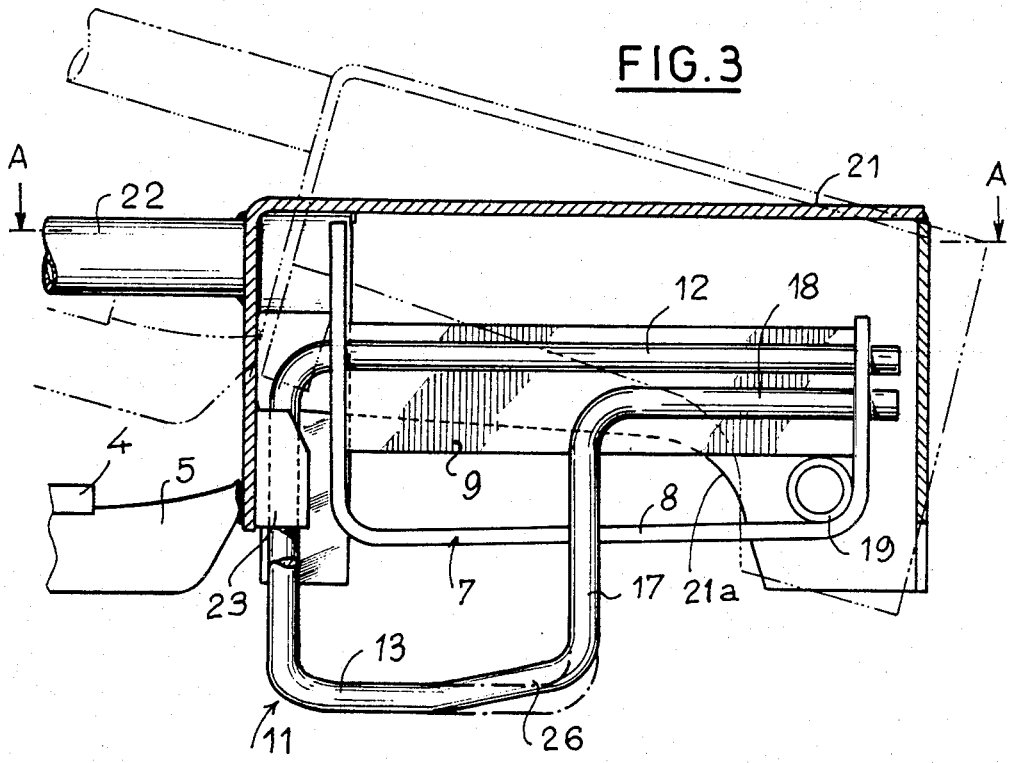
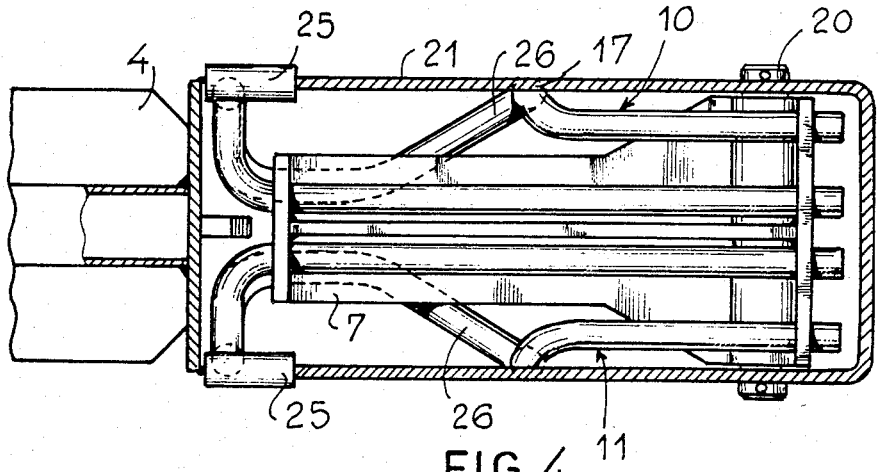
FIG. 4

DEVICE FOR SLOWING DOWN AND STOPPING MACHINES ROLLING ON RAILS

The present invention relates to braking and stopping devices for slowing down and stopping machines rolling on rails.

Devices of this type are known in particular for braking and stopping railway cars.

A known device comprises a wedge-shaped body one of the opposed sides of which bears against the upper rolling surface of the rail while the other side is adapted to come into contact with a wheel of the car to be stopped.

This wedge is extended forwardly toward its point by a strip portion which bears on the rolling rail and on which the wheel of the car must bear. At the rear of the wedge opposed to the strip portion, the device or shoe includes a handling handle.

The shoe further comprises, on the part of the wedge in contact with the rolling rail, two bars of small height which act as means for guiding and fitting the shoe on the rail.

This known device has a number of drawbacks.

The shoe bears against the rail under the effect of its own weight so that there is a danger of the shoe being ejected by an accidental contact of the shoe with some object, displaced by vibrations or removed by inattention.

Further, the fact that this device is merely placed on the rail, prevents the use thereof on a rolling track located above the ground, for example on a track for a overhead crane, since the risk of the falling of the device constitutes a permanent danger for the personnel and equipment located below.

In order to overcome these drawbacks, braking and stopping devices have been proposed in which the connection with the rolling rail is ensured by a pinching of the rail, which requires special parts and tooling and an excessively long assembling time to permit shifting the device as desired in accordance with requirements.

Other known devices are fixed to the rail by means of bolts extending through the rail or the support for the latter. Such an arrangement, apart from the fact that it requires a precise choice and an arrangement of the place for receiving the shoe, can only perform a function for stopping a machine which has been previously braked by another device.

French Pat. No. 2,495,085, filed on Nov. 4, 1980, discloses a safety shoe for slowing down and stopping a machine rolling on rails which comprises a body formed by a strip which bears against the rail and is adapted to be engaged under the wheel of the machine to be stopped and a block constituting a stop for the wheel of the machine, there being provided a claw for fixing the shoe to the rail and pivotally mounted on the body and a lock for immobilizing the claw in the closing position.

Although this shoe gives good results, it has the drawback of comprising relatively complicated parts for constituting the claw.

Further, the placing in position and the withdrawal of the shoe involve a number of handlings which render these operations relatively long to carry out.

Further, this shoe cannot be employed on track portions whose rails comprise connecting fishplates since the claw of the shoe encounters the fishplates without possibility of avoiding them.

An object of the invention is to overcome these drawbacks and to provide a device for slowing down and stopping of the type described in the aforementioned patent application, which combines great simplicity of manufacture with a rapidity of mounting and withdrawal as compared to known devices.

The invention therefore provides a device for slowing down and stopping for machines rolling on rails, comprising a body for placing on the rail for the purpose of receiving a wheel of a machine to be slowed down and stopped and constituting an abutment for said wheel, and means for connecting the device with the rail, wherein the connecting means comprise a plate carrying elastically yieldable claws which are maintained spread apart in the position of rest, said plate being adapted to be applied against the rail and being pivotally connected to means for moving said claws toward each other for the purpose of closing them under the head of the rail, said claw moving means being connected to the body of the device.

Further features of the invention will be apparent from the ensuing description with reference to the accompanying drawings, which are given merely by way of example and in which:

FIG. 1 is an exterior elevational view of the slowing down and stopping device according to the invention;

FIG. 2 is an end elevational view of the device of FIG. 1 placed on a rail and to an enlarged scale;

FIG. 3 is an elevational and sectional view of the device of FIG. 2, and

FIG. 4 is a sectional view taken on line A—A of FIG. 3.

The slowing down and stopping device represented in FIG. 1 mainly comprises a body 1 for bearing against the rail and braking and including a strip 2 on which a wheel of the machine to be slowed down or stopped must bear, an inclined block 3 forming an abutment for the wheel of the machine and connected to a sole 4 which has flanges 5 for guiding and fitting the shoe on the head of a rail R which has a narrower web below said head.

Fixed to the end of the body 1 opposed to the strip 2, is a device for connecting the shoe and rail together. This connecting device, shown in detail in FIGS. 2 to 4, comprises a plate 7 of sheet steel formed by a U-shaped member 8 having unequal branches and reinforced by a vertical web 9 welded to the interior of the U-shaped member. The web 9 is disposed on the longitudinal axis of symmetry of the plate 7 and consequently divides this plate into two equal parts. Pivotally mounted on each side of the web 9 are two claws 10 and 11 which are adapted to engage with the head of the rail R in the manner shown in FIG. 2.

The claws 10 and 11 are made from spring steel wires. Each of the claws has a first rectilinear section 12 which extends through the branches of the U-shaped member 8 owing to the provision of apertures for this purpose; the first rectilinear section 12 is extended by a loop 13 which, as shown in FIG. 2, includes an inclined portion 14 which extends away from the first section 12, this inclined portion being followed by a substantially vertical portion 15 which is extended by a cranked portion 16 so that the portion 16 is capable of trapping the head of the rail R. The loop 13, the sections 14, 15 and 16 of which are located outside the plate 7, terminates in a roughly vertical section 17 which extends inwardly of the plate between the two branches of the U-shaped member 8 and is extended by a second horizontal rectilinear section 18 whose end is engaged in a corresponding aperture formed in the rear branch of the U-shaped member 8 and offset with respect to that receiving the end portion of the first section 12. Thus each of the claws 10 and 11 is pivotally mounted in the plate 7. This plate has in its rear part a tubular member 19 which is welded to the U-shaped member 8 in the region of the junction between its rear branch and its horizontal part. The member 19 carries, extending therethrough, a pin 20 by means of which the plate 7 is pivotally connected to a case 21 of generally parallelepipedic shape connected to the rest of the shoe by means of a rod 22 welded at one end to the case 21 and at its other end to the body 1 of the shoe. The case 21 is part of moving means for moving the claws to their operative position engaged round and under the head of the rail and has in its lateral sides notches 21*a* for allowing the claws 10 and 11 to spread apart when the shoe reaches a region in which fishplates are provided for interconnecting two rail sections.

Inside its front end wall opposed to the pivot pin 20, the case 21 includes a member 23 for limiting the rotation of the plate 7 with respect to the case so as to ensure that this plate does not move completely out of the case when the shoe is withdrawn from the rail.

Formed in the side walls of the case 21 are openings 24 in which are mounted spring strips 25 the free end portions of which bear against the roughly vertical sections 15 of each of the claws 10 and 11 so as to maintain their loop 13 in engagement with the head of the rail in the manner shown in FIG. 2.

The slowing down and stopping device shown in FIGS. 2 to 4 was designed for use on track sections whose rails include rail-connecting fishplates. When the device is locked on a rail, its claws must be capable of spreading apart when the device reaches the connecting fishplates. For this purpose, each of the loops 13 of the claws 10 and 11 has in its lower section 16 a portion 26 which is shown clearly in FIGS. 3 and 4 and which extends away from the axis of symmetry of the device.

When the slowing down and stopping device according to the invention is not intended to be employed on a track whose rails include fishplates, the claws 11 and 12 may have the shape shown in dot-dash lines in FIG. 3. Further, in the case of a use of the device with no requirement to spread the claws 11 and 12 apart, the case 21 may have solid lateral walls without the notches 21*a* and without the claw-maintaining springs strips 25.

The device just described operates in the following manner.

The manner in which the claws 11 and 12 are mounted in the plate and their shape are such that, when the claws are free, they have a tendency to assume, owing to their resilience, positions in which they are spread apart so as to permit the passage of the head of the rail R therebetween. The device may be held by the operator by the rod 22 connecting the case 21 to the body 1 which also acts as a handle. The case then occupies the position shown in dot-dash lines in FIG. 3, the claws 10 and 11 are spread apart under the effect of their resilience. The plate 7 abuts by the front branch of the U-shaped member 8 against the abutment 23 so that it can only partly move out of the case 21 and does not interfere with the handling of the device.

When it is desired to place the device according to the invention on a rail, the device is placed in such manner that the plate 7 bears against the rail, the claws 11 and 12 being in their open position, and then the assembly comprising the body 1, the strip 2 and the case 21 is lowered in such manner that this assembly comes into contact with the rail R. Consequently, the strip 2 is applied against the rail, the flanges 5 of the sole 4 are placed on each side of the head of the rail, and the case 21, in rotating about the pin 20, causes the claws 11 and 12 to move toward each other so that the portions 16 of the claws surround the head of the rail in the manner shown in FIG. 2. The device is then in position and can perform its slowing down and stopping function.

When a wheel of the machine reaches the device, it first mounts on the strip 2 of the latter and then bears against the abutment 3 so that, under the effect of the inertia of the machine, the device is moved by sliding on the rail, the slowing down being achieved by the friction of the strip and of the sole 4 under the effect of the weight carried by the wheel of the machine. Up to this point, the operation of the device according to the invention is similar to that of the prior devices. However, when the device reaches the fishplates interconnecting two rail sections, designated by the reference character E in FIG. 2, the claws 10 and 11 come into contact with the fishplates E by their loop portion 26 in the shape of a ramp. Consequently, as the device is moved in translation relative to the fishplates, the claws 10 and 11 spread apart in opposition to the clamping action of the spring strips 25. When they have been spread apart, the claws 11 and 12 have the position shown in dot-dash lines in FIG. 2. It can be seen that this spreading apart is allowed owing to the notches 21*a* provided in the case 21. In the spread-apart position, the lower sections 16 of the loops 13 of the claws 11 and 12 bear against the fishplates E. When the device continues to travel along the rail, after its passage over the fishplates, the spring strips 25 once again apply the claws 11 and 12 under the head of the rail so that the device is once again connected to the rail.

If it is desired to withdraw the slowing down and stopping device, it is sufficient to raise the assembly comprising the strip 2, the body 1 and the case 21 by means of the rod 22 constituting a handle. In this operation, the case 21 rotates with respect to the plate 7 about the pin 20 and its lateral walls release the claws 11 and 12. Owing to their resilience, the latter spread apart and consequently no longer trap the head of the rail R.

It can be seen that the device just described is extremely simple to handle, since it is placed on, and connected to, the rail by one and the same movement which merely comprises placing the sole 4 on the rail, the claws 11 and 12 being moved toward each other in the course of the relative movement of the plate 7 inside the case 21 under the effect of the weight of the assembly. The device is withdrawn also by a simple traction on the handle 22 which raises the assembly comprising the strip 2, the body 1 and the case 21 and releases the claws 11 and 12 and consequently allows the claws to spread apart under the effect of their resilience.

It will moreover by observed that the device according to the invention is constructed with very simple component parts which require no machining operation for their assembly, so that the device is inexpensive.

Having now described my invention what I claim as new and desire to secure by Letters Patent is:

1. A slowing down and stopping device for a machine rolling on rails which have a head and a narrower web below said head, said device comprising a longitudinal axis and a longitudinally extending body for placing on top of said head of the rail for the purpose of receiving on top of the body a wheel of said machine and forming an abutment for said wheel, and means for connecting the device to the rail, the connecting means comprising a plate, resiliently yieldable claws which are mounted on the plate and are movable relative to said plate transversely of said axis between a spread-apart first position of rest for receiving said head therebetween and a second position in which said claws can close around and engage under said head, the plate being adapted to be applied against the top of the rail, and moving means pivotally connected to the plate and pivotable relative to said plate about an axis extending transversely of said longitudinal axis between an inoperative position in which inoperative position said moving means allow said claws to assume said first position and operative positions in which operative positions said movable means are cooperative with said claws for moving said claws toward each other and maintaining said claws in said second position thereof, said moving means comprising an element which is pivotally mounted on said plate and is rigid with said body so that said body is also pivotable about said transverse axis.

2. A device according to claim 1, wherein said claws are made from spring steel wire and each comprise two rectilinear sections pivotally mounted on the plate and extending in directions parallel to a longitudinal axis of the device and interconnected by a loop for closing round the head of the rail under the effect of said moving means.

3. A device according to claim 2, wherein said plate is formed by a U-shaped member having unequal branches and provided with a reinforcing web which is welded to said branches, the claws being pivotally mounted in the branches of said U-shaped member on each side of said web.

4. A device according to claim 3, wherein the first rectilinear section of each of the claws is engaged in apertures formed in each of the branches of the U-shaped member and the second rectilinear section is engaged in an aperture formed in a single one of the branches of said U-shaped member and offset relative to the aperture formed in the same branch and receiving the first rectilinear section of the claw.

5. A device according to claim 3, wherein said element of said moving means comprises a case having a generally parallelepipedic shape and an open side and fixed to the body of the device by a rod constituting a handle, said plate being pivotally mounted within said case and said case comprising lateral walls cooperative with said claws in said operative positions of said moving means.

6. A device according to claim 5, for placing on a rail provided with rail section-connecting fishplates, wherein the loops of the claws each comprise a portion in the shape of a ramp which extends away from said longitudinal axis, and the lateral walls of the case define notches which permit the claws to spread apart when they come into contact with said fishplates, and said moving means comprise elastically yieldable means for elastically retaining the claws in said second position when the device is out of contact with said fishplates.

7. A device according to claim 5, wherein said moving means comprise spring strips mounted on the lateral walls of said case for elastically engaging and retaining the claws in said second position.

8. A device according to claim 2, wherein the first rectilinear section of each of the claws is engaged in apertures formed in each of the branches of the U-shaped member and the second rectilinear section is engaged in an aperture formed in a single one of the branches of said U-shaped member and offset relative to the aperture formed in the same branch and receiving the first rectilinear section of the claw.

9. A device according to claim 8, wherein said element of said moving means comprises a case having a generally parallelepipedic shape and an open side and fixed to the body of the device by a rod constituting a handle, said plate being pivotally mounted within said case and said case comprising lateral walls cooperative with said claws in said operative positions of said moving means.

10. A device according to claim 9, for placing on a rail provided with rail section-connecting fishplates, wherein the loops of the claws each comprise a portion in the shape of a ramp which extends away from said longitudinal axis, and the lateral walls of the case define notches which permit the claws to spread apart when they come into contact with said fishplates, and said moving means comprise elastically yieldable means for elastically retaining the claws in said second position when the device is out of contact with said fishplates.

11. A device according to claim 9, wherein said moving means comprise spring strips mounted on the lateral walls of said case for elastically engaging and retaining the claws in said second position.

12. A device according to claim 2, wherein said element of said moving means comprises a case having a generally parallelepipedic shape and an open side and fixed to the body of the device by a rod constituting a handle, said plate being pivotally mounted within said case and said case comprising lateral walls cooperative with said claws in said operative positions of said moving means.

13. A device according to claim 12, for placing on a rail provided with rail section-connecting fishplates, wherein the loops of the claws each comprise a portion in the shape of a ramp which extends away from said longitudinal axis, and the lateral walls of the case define notches which permit the claws to spread apart when they come into contact with said fishplates, and said moving means comprise elastically yieldable means for elastically retaining the claws in said second position when the device is out of contact with said fishplates.

14. A device according to claim 12, wherein said moving means comprise spring strips mounted on the lateral walls of said case for elastically engaging and retaining the claws in said second position.

15. A device according to claim 1, wherein said element of said moving means comprises a case having a generally parallelepipedic shape and an open side and fixed to the body of the device by a rod constituting a handle, said plate being pivotally mounted within said case and said case comprising lateral walls cooperative with said claws in said operative positions of said moving means.

16. A device according to claim 15, for placing on a rail provided with rail section-connecting fishplates, wherein the claws each comprise a portion in the shape of a ramp which extends away from said longitudinal axis, and the lateral walls of the case define notches which permit the claws to spread apart when they come into contact with said fishplates, and said moving means comprise elastically yieldable means for elastically retaining the claws in said second position when the device is out of contact with said fishplates.

17. A device according to claim 16, wherein said elastically yieldable means comprise spring strips mounted on the lateral walls of said case.

18. A device according to claim 17, further comprising a member for limiting the rotation of the plate relative to said case so as to prevent the plate from completely moving out of said case.

19. A device according to claim 16, further comprising a member for limiting the rotation of the plate relative to said case so as to prevent the plate from completely moving out of said case.

20. A device according to claim 15, further comprising a member for limiting the rotation of the plate relative to said case so as to prevent the plate from completely moving out of said case.

* * * * *